United States Patent [19]

Spencer

[11] Patent Number: 4,665,304

[45] Date of Patent: May 12, 1987

[54] ANTI-CONDENSATION MIRROR

[76] Inventor: A. George Spencer, 18303-67 Ave., Edmonton AB, Canada

[21] Appl. No.: 607,001

[22] Filed: May 4, 1984

[51] Int. Cl.[4] ..... H05B 3/36

[52] U.S. Cl. ..... 219/219; 219/548; 219/522

[58] Field of Search ..... 219/219, 202, 345, 522, 219/548, 549, 543; 338/308, 309

[56] References Cited

U.S. PATENT DOCUMENTS

| | | | |
|---|---|---|---|
| 2,564,836 | 8/1951 | Elsenheimer | 219/219 |
| 3,530,275 | 9/1970 | Rust | 219/219 |
| 3,597,586 | 8/1971 | Rebovich | 219/219 |
| 3,686,473 | 8/1972 | Shirn | 219/219 |
| 3,749,886 | 7/1973 | Michaelsen | 219/543 |
| 3,839,620 | 10/1974 | Seibel | 219/543 |
| 3,852,566 | 12/1974 | Quirk | 219/543 |
| 4,071,736 | 1/1978 | Kamerling | 219/219 |
| 4,468,557 | 8/1984 | Bylin | 219/549 |
| 4,485,297 | 11/1984 | Grise | 219/543 |

FOREIGN PATENT DOCUMENTS

| | | | |
|---|---|---|---|
| 1959650 | 6/1971 | Fed. Rep. of Germany | 219/219 |
| 2033982 | 2/1972 | Fed. Rep. of Germany | 219/219 |
| 52-41936 | 3/1977 | Japan | 219/345 |
| WO79/00705 | 9/1979 | PCT Int'l Appl. | 219/345 |
| 1391425 | 4/1975 | United Kingdom | 219/219 |

*Primary Examiner*—E. A. Goldberg
*Assistant Examiner*—Teresa J. Walberg
*Attorney, Agent, or Firm*—Ridout & Maybee

[57] ABSTRACT

A heating element for bathroom and similar mirrors is formed as a laminate for placing behind a conventional mirror glass. The laminate has separate foil conductor patterns forming distribution and return conductors for the supply current, and a continuous conductor layer formed by a higher resistivity conducting paint or coating extending between the conductor patterns. Preferably the conductor patterns are formed as longitudinal bands on a continuous web of insulative substrate material which is then cut into lengths which are mounted on backing sheets of appropriate size and which carry buses to establish connection between the conductor bands and an electrical supply.

11 Claims, 8 Drawing Figures

ANTI-CONDENSATION MIRROR

This invention relates to anti-condensation mirrors for bathrooms and other interior locations where condensation is a problem.

The problem of condensation on mirrors temporarily exposed to warm, humid air, as in bathrooms, is of long standing and has proved remarkably intractible. The most common approach has been to improve bathroom ventilation, typically by the use of extractor fans, but this approach is usually no more than partially effective and in cold climates can be very wasteful of heat energy. Numerous proposals have been made to heat bathroom mirrors above the dew point so as to prevent condensation, but to the best of my knowledge none of these proposals has met with substantial commercial success.

I am aware of the following U.S. patents relating to direct electrical heating of bathroom mirrors to prevent fogging:

U.S. Pat. No. 4,060,712—Chang
U.S. Pat. No. 3,838,620—Seibel et al
U.S. Pat. No. 3,597,586—Rebovich
U.S. Pat. No. 3,160,736—Catterson
U.S. Pat. No. 2,564,836—Elsenheimer
U.S. Pat. No. 2,015,816—Pyzel
U.S. Pat. No. 3,887,788—Seibel et al
U.S. Pat. No. 3,790,748—Van Laethem et al
U.S. Pat. No. 3,530,275—Rust
U.S. Pat. No. 2,815,433—Zumwalt
U.S. Pat. No. 2,512,875—Reynolds I am also aware of the following United States patents using alternative methods of heating such mirrors:

U.S. Pat. No. 4,037,079—Armbruster
U.S. Pat. No. 3,384,977—Rosenberg
U.S. Pat. No. 3,732,702—Desch and of the following examples of U.S. patents relating to heated automobile rear view mirrors:

U.S. Pat. No. 4,352,006—Zega
U.S. Pat. No. 4,237,366—Berg
U.S. Pat. No. 4,061,601—Clary et al
U.S. Pat. No. 3,686,473—Shirn et al
U.S. Pat. No. 4,251,316—Smallbone
U.S. Pat. No. 4,071,736—Kamerling
U.S. Pat. No. 3,798,419—Maake
U.S. Pat. No. 3,624,347—Anderson et al Of the arrangements described in the foregoing patents, a substantial proportion in both the first and third groups require specially manufactured mirror glass, and many of the remainder of the first group and all of the second group require the mirror element to be incorporated in a special installation. The present applicant believes that it is essential for wide success of a product in this field that it can: (a) utilize conventional widely available mirror glass, and (b) be compatible with conventional mirror installation techniques. Furthermore, assuming electrical operation, the device must (c) be capable of complying with applicable electrical safety codes, and must (d) be capable of being manufactured economically for application to any of a very wide range of mirror sizes.

In order to meet requirements (a) and (b) above, it is believed that the most practical approach is to provide a sheet-like heating element sufficiently thin that it can be mounted behind a sheet of conventional mirror glass without preventing the use of standard or existing mirror mounting hardware or frames. In order to meet requirement (c), the element must in general either be operated at low voltage using an appropriately designed and installed transformer, or be operated in a circuit including a ground fault interrupter (GFI). In the latter case, it is particularly important to minimize electrical leakage from the circuit, since such leakage will trip the GFI. Requirement (d) means that it must be possible to produce to order heating elements of any desired lineal dimensions without incurring significant tooling costs.

To the best of my knowledge, no prior proposal for an electrically heated bathroom mirror is suited to meet all of the above requirements.

Of the patents listed above, several describe heating elements for mounting behind conventional mirrors. U.S. Pat. No. 4,060,712 issued to Chang, comprises a resistance wire heating element wound on an insulating support. Clearly, the element would need to be redesigned for each different size of mirror, and once provided with adequate external insulation would be of significant thickness. The resistance wire itself has only a very small surface area, and would thus need to be operated at fairly high temperature whilst it depends on the conductivity of the mirror glass itself to heat areas not immediately adjacent the resistance wire.

The Seibel et al U.S. Pat. Nos. 3,839,620 and 3,887,788 come closest to meeting the requirements set forth by the present applicant. These patents propose use of a heating element in the form of a printed circuit board for mounting behind a mirror element. The board carries a sinuous planar conductor which forms the heating element proper. Since the conductor has a large surface area in contact with the mirror, it can be operated at moderate temperature, and with suitable conductor layout, fairly uniform heating of the mirror should be achieved. In certain embodiments, ground plane conductors are provided adjacent the edges of the board to minimize electrical leakage. Disadvantages of this approach are that the conductor pattern and associated tooling must be redesigned for each size of mirror to be equipped, and the long sinuous conductor patterns mean that the element can fail as a result of comparatively trivial mechanical or corrosion damage interrupting the printed circuit trace at any point. This problem becomes more serious in elements designed to operate at line voltage, since the trace will be very long and thin in order to provide a high enough resistance.

The Maake U.S. Pat. No. 3,798,419 shows a heating element of robust construction intended for use with automobile rear view mirrors. However the approach utilized is only suitable for high current low voltage applications where rapid heating of a small area is required, and it is thought that it would not be suitable for use with large bathroom mirrors because a large and expensive transformer would be required.

The present invention seeks to provide a heating element for bathroom and similarly located mirrors, and installations incorporating such an element, which can be made safe and reliable in operation, and manufactured economically to suit any desired size of mirror.

According to the invention, there is provided a heating element for bathroom mirrors, comprising a laminate formed by a thin electrically insulative substrate layer, and a plurality of conductive layers supported by said substrate layer, comprising a first relatively low resistivity conductive layer, a second relatively low resistivity conductive layer, and a third relatively high resistivity conductive layer in electrical contact with the first and second conductive layers, the first and second conductive layers each forming bus structures separated from one another in the plane of the layers, with the third conductive layer forming the only electrical connection between the first and second layer, said third layer being substantially continuous and formed by an electrically conductive paint or coating. Normally the first and second conductive layers will be coplanar, and typically formed by foil traces on the substrate layer, and the third conductive layer will be a conductive paint or coating material sprayed, rolled, screened or otherwise applied to the substrate layer over the foil traces. Typically the laminate so produced is in turn laminated to a support layer so as to sandwich the conductive layers. The support layer also provides support for a terminal assembly and bus conductors establishing independent connections between the first and second conductive layers and the terminal assembly. Since the dissipation per unit area of the element is mainly dependent upon the resistivity of the third conductive layer and the spacing between proximate portions of the first and second conductive layers, a standard conductor pattern and spacing can be used for any size of element, and elements can readily be assembled to any required size. Most conveniently this standard conductor pattern is formed as part of a method of manufacture which comprises forming the first and second conductor layers as parallel stripes or ribbons extending longitudinally of a continuous web which is cut in suitable lengths for assembly to the support layer.

Further features of the invention will become apparent from the following description of preferred embodiments.

Figure 2:
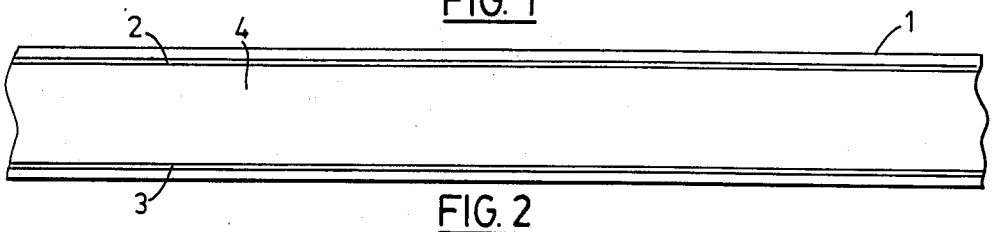
FIGS. 2, 3 and 4 are plan views of portions of three different forms of laminate which may be utilized in forming elements according to the invention.
Figure 3:
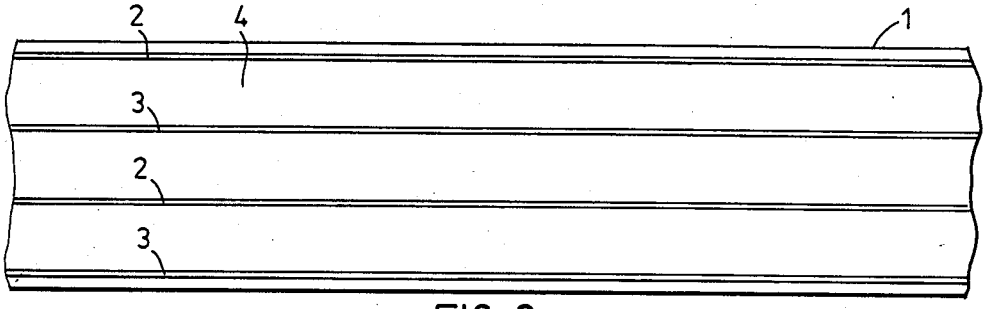

Referring now to the drawings, the present invention is based upon the use of a laminate, one embodiment of which is shown in FIG. 2. The laminate is based on a continuous strip of flexible synthetic plastic film or alternative flexible electrically insulating web material such as impregnated paper or fabric. The selection of material will depend on the maximum temperature to be reached by the element, and the degree of electrical insulation required. For example, polyimide films are available which have excellent insulating properties even in very thin films, together with the ability to withstand continuous temperatures of 250° C. Other suitable materials can be found discussed in standard reference books for electrical engineers. The web 1 is unrolled and two longitudinal parallel strips 2 and 3 of highly conductive foil are glue bonded to the web. Copper and aluminum are suitable foil materials, the foil width and thickness being selected to be sufficient to carry a current the magnitude of which can readily be determined once the nature of the invention is understood. A further third conductive layer 4 is then applied to the remaining surface of the web and so as to cover or at least overlap the first and second conductive layers formed by the foil strips. This layer is selected to be of much higher sheet resistivity than the foil strips, and is typically formed by a film of conductive paint, the film thickness and material being selected in the light of the spacing between the foil strips so as to provide a sheet resistivity which will result in a predetermined energy dissipation per unit area when a predetermined potential difference is applied between the strips. In practice, I find that with 5 mm thick mirror glass, the amount of heat required to prevent misting in interior application is about 0.011 to 0.013 watts per square centimeter, although to accelerate initial heating, a dissipation of about 0.02 watts per square centimeter is preferred, in conjunction with some form of control to achieve energy conservation. Even this higher rate of heating will not raise the mirror glass to dangerous temperatures if the control unit should fail. Depending on the voltage of operation (e.g. voltages below 30 volts for low voltage operation on the one hand and 120 volts for line operation on the other hand), sheet resistivities between less than 3 and over 1000 ohms per square may be suitable, and such resistivities are readily achieved using conventional film thicknesses and available conductive paints. A range of suitable paints and coatings using various primary vehicles is available for example from Acheson Colloids Company under the trade mark ELECTRODAG, from Dexter Corporation under the trade mark HYSOL, and from Technical Wire Products Inc. under the trade mark TECKNIT. Actual choice depends upon the resistance required, the suitability of the paint vehicle for the material of the substrate, the method used to apply the coating, and the cost of the material, the lower resistance materials being in general more costly. Suitable materials that I have tried include TECKNIT acrylic 3B, 10 and 100, and TECKNIT latex 1000, the numerals indicating the maximum sheet resistivity in ohms of a 2 mil film of the material concerned. For example, in order to obtain a dissipation of 0.02 watts per square centimeter with an applied material of 24 volts, and using a 2 mil film having a resistivity of 30 ohms per square, the strips 2 and 3 should be about 30 centimeters apart. However, using a considerably cheaper coating having a resistivity of 100 ohms per square, a conductor spacing of 15 centimeters is required. In this case it may be convenient to provide additional alternating foil strips 2 and 3 as shown in FIG. 3. In each case the foil strips are dimensioned so as to be able to carry sufficient current to energize the maximum length of the laminate likely to be required in any particular application.

Figure 4:
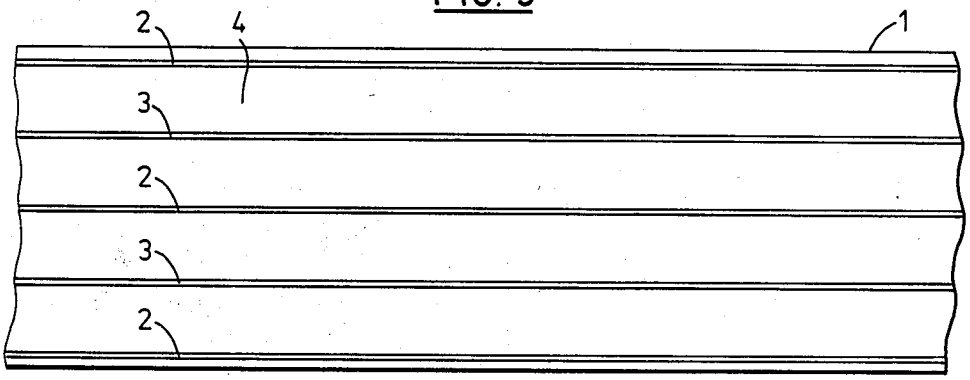
Figure 6:
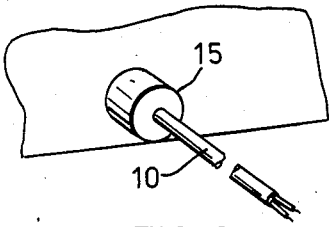
FIG. 6 is a fragmentary rear view of the terminal block of the element of FIG. 5.

Low voltage operation as considered further below will usually be appropriate where the circuit used to supply the mirror heater is not provided with a ground fault interrupter. In original installations in which it can be ensured that the supply circuit is GFI protected, an element operating at line voltage can be used. In this case, using a coating of 1000 ohms per square resistivity, or strip spacing of about 20–25 centimeters is appropriate. However, a somewhat higher resistivity and narrower spacing of the strips may be appropriate so that an odd number of strips 2 and 3 can be accommodated on the web 1. This enables the outermost strips both to be connected to the neutral conductor thus minimizing the risk of current leakage such as may trip the GFI. Such an arrangement is shown in FIG. 4.

Figure 1:
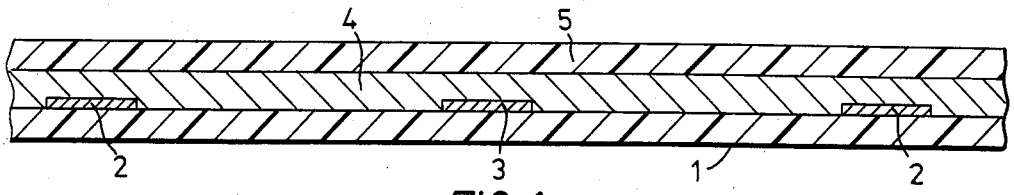
FIG. 1 is a fragmentary section through an element in accordance with the invention.
Figure 5:
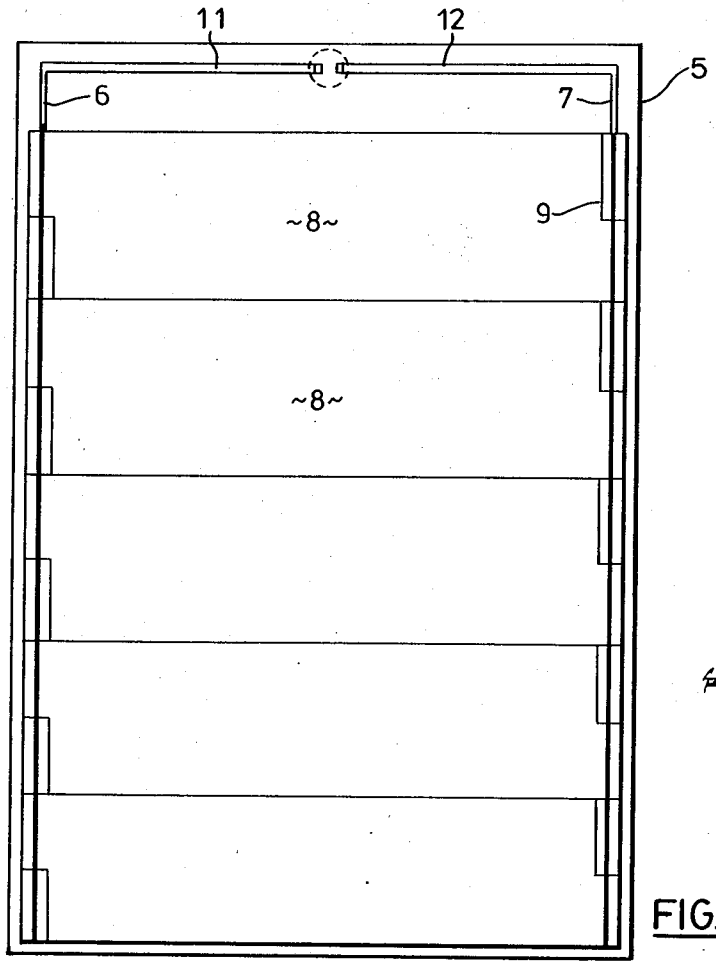
FIG. 5 is a plan view of an assembled heating element.

Referring now to FIG. 1, which shows a section (not to scale) through part of a heating element as discussed with reference to FIG. 3 or 4, it will be noticed that a second insulating layer 5 is provided in the finished element. This is described more fully with reference to FIG. 5. The laminate discussed with reference to FIG. 2, 3 or 4 is bonded to a support layer 5 which may be selected similarly to the layer 1, and serves both to protect and insulate the conductive layer and to establish connections to the laminate. To this end, conductor strips 6 and 7 are bonded to locations spaced from opposite margins of the layer 5, which will usually be of approximately the size of the mirror to be heated, the strips being able to carry the total current required by the completed element. These strips 6 and 7 are electrically bonded to the foil strips of the laminate. Depending on the size of the element and the spacing of the strips on the laminate, a single length of the latter may be used, with its strips 2 and 3 parallel with and overlying the strips 6 and 7 to make contact, or one or several lengths 8 of laminate may extend laterally, the lengths being cut at the ends as at 9 so that only the strips 2 make contact with the strips 6, and only the strips 3 with the strips 7. Elements may thus readily be assembled to fit any size of mirror, leaving a peripheral margin free from conductive material as shown in FIG. 5.

In order to establish connection to the element, which will typically be only about 0.4 mm thick, terminals 10 are stapled or otherwise fastened through the element to extensions 11 and 12 of the conductors 6 and 7, and the terminals are secured to the conductors at a cable 14 within an enclosure 15 which may be moulded in situ from a suitable rubber or synthetic plastic.

Figure 7:
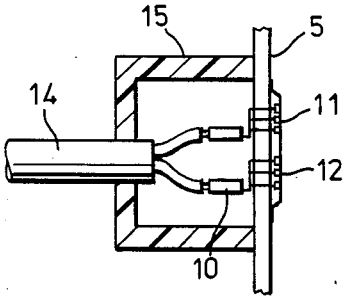
FIG. 7 is a section through the terminal block shown in FIG. 5.
Figure 8:
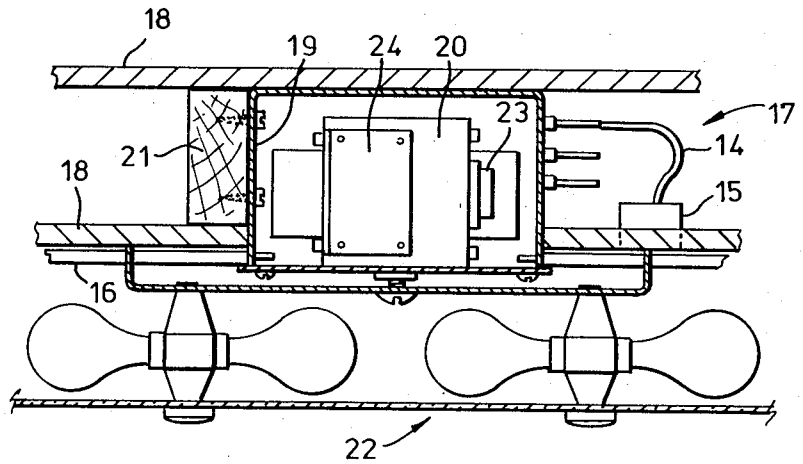
FIG. 8 is a fragmentary section of a bathroom wall illustrating an exemplary installation of an element in accordance with the invention.

The resulting element may be mounted behind either an existing mirror, or during installation of a mirror 16 (see FIG. 8), and is sufficiently thin that it will not prevent use of conventional mirror mounting hardware. The enclosure 15 may either be arranged so as to emerge in a housing beyond the edge of the mirror, or to project into a wall recess or cavity 17 behind the mirror as shown in FIG. 7, through an opening in drywall or other wall cladding 18. If a transformer 20 is required to feed the heater it may be housed in a junction box 19 mounted to a wall stud and supporting a light fitting 22 also fed from the junction box. Additionally, the junction box may house a fuse 23 in series with the heating element and the transformer secondary, and a control circuit 24.

As mentioned above, it is desirable that the element have a sufficient dissipation per unit area to provide a reasonably quick warm up to a temperature sufficient to raise the mirror temperature above the dew point in the room in which it is installed. It is also desirable to avoid heating the mirror unnecessarily when the room is not in use.

Proposals have been made to use dew-point sensors to control mirror heaters, but I believe that this will usually be an unnecessary complication. A good measure of economy can be achieved using a timer arranged so that switching on a bathroom light will turn on the heater, which will then be turned off after a predetermined interval. Such an arrangement will also often render a thermostat unnecessary. The heater is connected in parallel with the room light, with the control circuit 24 in series with the heater (or with the primary of the heater transformer). The control circuit 24 incorporates a solid state timer preset to maintain a triac in series with the supply in a conducting condition for an appropriate period (typically 20 minutes), after which the heater is switched off until it is reset the next time the switch is turned on. Such timers are well known in the art and need not be described here.

I claim:

1. A bathroom mirror installation comprising as separately formed elements a mirror glass, a supporting surface against which the mirror glass is mounted substantially flush, and a thin heating element sandwiched between the glass and the supporting surface and wholly covered by but separate from the glass, the heating element comprising a flexible laminate formed by a thin electrically insulative substrate layer and a plurality of conductive layers supported by said substrate layer, including a first relatively low resistivity conductive layer, and a third relatively high resistivity conductive layer in electrical contact with the first and second conductive layers, the first and second conductive layers each forming bus structures separate from one another in the plane of the layers, with the third conductive layer forming the only electrical connection between the first and second layer, said third layer being substantially continuous and formed by an electrically conductive coating, an electrically insulative support layer, to which said laminate is further laminated so that the conductive layers are sealed between the substrate and support layers, and a terminal assembly mounted on the support layer and including bus conductors disposed to make contact with the first and second conductive layers respectively, the terminal assembly having integral external connections emerging out of the plane of the element into an opening in the supporting surface beneath the mirror glass, and the heating element having a substantially uniform heat dissipation when energized of about 0.01 to about 0.02 watts per square centimeter.

2. An installation according to claim 1, wherein the first and second conductive layers are coplanar.

3. An installation according to claim 1, wherein the element has a peripheral margin free from conductive material.

4. An installation according to claim 1, wherein the first and second conductive layers are spaced parallel strips of relatively highly conductive material.

5. An installation according to claim 4, wherein the strips are strips of metal foil.

6. An installation according to claim 5, wherein the substrate layer comprises an elongated web of flexible insulating material, with the strips of foil extending longitudinally of the web.

7. An installation according to claim 5, wherein at least one of the first and second conductive layers comprises more than one strip of foil.

8. An installation according to claim 7, having an odd number of strips, and wherein the strips of foil nearest edges of the substrate layer are both part of the same conductive layer.

9. An installation according to claim 1, wherein the terminal assembly establishes connections between the buses and a supply cable within an integrally moulded housing.

10. An installation according to claim 9, wherein the projecting portion of the terminal assembly projects rearwardly through the supporting surface, and the supply cable extends behind the supporting surface to a junction box behind the supporting surface.

11. An installation according to claim 10, including a low voltage transformer within the junction box to which the cable is connected.

* * * * *